United States Patent [19]

Novey

[11] Patent Number: 4,946,411

[45] Date of Patent: Aug. 7, 1990

[54] HAND HELD REMOTE CONTROL FOR OUTBOARD POWERHEADS

[76] Inventor: Richard T. Novey, 1031 Linden Ave., Glendale, Calif. 91201

[21] Appl. No.: 260,506

[22] Filed: Oct. 20, 1988

[51] Int. Cl.[5] ..... B63H 25/24

[52] U.S. Cl. ..... 440/84

[58] Field of Search ..... 440/1, 2, 53, 58, 60, 440/84–87, 75; 114/144 E, 144 A; 74/480 B

[56] References Cited

U.S. PATENT DOCUMENTS

| | | | |
|---|---|---|---|
| 2,804,838 | 9/1957 | Moser | 115/18 |
| 3,580,212 | 5/1971 | Fortson | 115/39 |
| 3,865,063 | 2/1975 | Norton | 440/87 |
| 3,989,000 | 11/1976 | Foley, Jr. | 115/18 |
| 4,432,737 | 2/1984 | Johansson | 440/60 |
| 4,669,987 | 2/1987 | Schulte | 440/6 |
| 4,715,836 | 12/1987 | Schulte | 440/6 |
| 4,739,236 | 4/1988 | Burkenpas | 440/1 |

*Primary Examiner*—Joseph F. Peters, Jr.
*Assistant Examiner*—Edwin L. Swinehart
*Attorney, Agent, or Firm*—William H. Maxwell

[57] ABSTRACT

A hand held control for the operational functions of the outboard powerhead of a boat, having reversible motor drives for steering, shifting and throttling, and a circuit for controlling each function.

8 Claims, 3 Drawing Sheets

GEAR SHIFT
THROTTLE
CAM
STEERING
REVERSE
NEUTRAL
FORWARD
SLOW
START
FAST
LEFT
RIGHT
M2 & M3
A & B

HAND HELD REMOTE CONTROL FOR OUTBOARD POWERHEADS

BACKGROUND

This invention relates to the control of outboard motors for small recreational vessels, whereby steering, throttling and shifting are remotely controlled. It is the powerhead of an outboard motor unit that is involved, such units being self contained for the most part. That is, the engine and its accessories and controls are incorporated in the powerhead from which a drive tube depends into the water where the propeller assembly operates, and all of which is pivotally carried by a bracket secured by a clamp frame to the transom of the vessel so as to swing upwardly on a transverse axis to avoid grounding, and so as to be trimmed for propulsion.

Steering is by means of vertical pivoting of the powerhead-drive tube-propeller assembly on the swinging bracket, with a forwardly projecting steering handle or with cables extending from an equivalent steering bracket to a pilot station having a steering wheel or the like.

Throttling is by means of a lever system that controls carburetion and spark advance or retard; assuming that most all outboard engines are internal combustion gasoline engines and the like. In practice, throttle control is by means of a manipulatable throttle lever at the front face of the powerhead or by a push-pull cable extending from the powerhead to a pilot station having an eqivalent steering wheel or lever.

Shifting is by means of a lever system that engages the propeller assembly for forward and reverse operation, the engine having one direction of rotation. In practice, shifting is accomplished by a dog clutch that engages gearing within the propeller assembly at the lower end of the drive tube, there being a shift lever at the powerhead, usually at one side thereof, for manipulation into any one of three modes, (1) reverse, (2) neutral, and (3) forward. The shift lever control can be extended to a pilot station by a push-pull cable to be operated by an equivalent shift lever.

There are the three basic control functions of steering, throttling and shifting which are of primary concern, and there are the related engine functions of starting and stopping, it being a general object of this invention to coordinate all of these functions for control at a hand held pilot station that !s extended by an electrical cable to any desired location aboard the vessel being operated thereby. The supporting functions involving fuel and electrical battery power are state of the art, and control therefor is also included in the hand held remote control station as shown and later described.

Outboard motor powerheads are of compact design with the basic controls hereinabove referred to incorporated in the powerhead for control by lever operation. The typical powerhead is enhanced by a tight fitting housing, at the immediate exterior of which all of the functional controls are accessible for direct manual operation or by remote cable control, as above stated. It is an object of this invention to tie into these basic controls as they are accessible at the powerhead, and to provide electrical servo operation therefor controlled remotely by a mobile hand held pilot station. Electrical power for operation of this system is provided by the existant battery power supply of the outboard motor.

It is an object of this invention to incorporate a steering servo in the powerhead of an outboard motor, for steering the vessel powered thereby from a remote hand held pilot station. Outboard motors of the type under consideration have a steering bracket for remote cable steering, and this steering bracket closely overlies the mounting frame that is clamped to the transom of the vessel. It is this steering bracket and mounting frame relationship that is advantageously employed herein to carry a gear segment or the like and a servo pinion, the servo motor thereof being reversely controlled by the remote hand held pilot station to turn the powerhead left and right.

It is an object of this invention to incorporate a throttle servo at the powerhead of an outboard motor, for speed control of the vessel powered thereby, from a remote hand held pilot station. Outboard motors of the type under consideration have a throttle lever system that simultaneously positions the caburetor butterfly-valve and the ignition spark advance-retard. It is this lever system that is advantageously employed herein to incorporate a servo motor drive therefor reversely controlled by the remote hand held pilot station to determine the speed of the vessel.

It is an object of this invention to incorporate a shift servo at the powerhead of an outboard motor, for reverse, neutral and forward modes of operation. Outboard motors of the type under consideration have a shift lever accessible at the exterior of the powerhead housing, and it is this lever which is advantageously employed herein to incorporate a servo motor drive to selectively put the shift lever into any one of the said three modes for operation, reverse, neutral or forward.

The steering of the vessel is a constant function that requires instant response and rapid operation with substantial torque. It is an object of this invention to provide these requirements by employing a small high speed continuous duty motor with high gear reduction to the pinion shaft that shifts the steering from left to right. In practice, the motor servo has a geared head which is coupled to a worm gear speed reducer by a flexible drive cable. The worm gear locks the steering position when the servo stops, the small high speed motor being characterized by quick acceleration and deceleration as well.

The throttle control is an intermittent function that requires instant response and rapid operation with moderate torque. It is an object of this invention to provide these requirements by employing a small high speed motor with a high gear reduction that shifts a screw jack to reciprocably position the throttle lever system. As shown, there is a nut reversely rotated by the servo motor to position a threaded drive rod. The drive rod inherently locks in selected positions when the servo motor stops.

The shift control is an intermittent function that requires instant response and rapid operation with substantial torque. A particular requirement of the shift control is the establishment of three distinct mode positions; reverse, neutral and forward. Accordingly, the servo for this shift control is essentially the same as the throttle control, but includes a multi position cam control that involves an electrical circuitry as hereinafter described. In carrying out this three mode positioning of the servo, the aforesaid drive rod and nut are engaged with a screw thread having a fast pitch, while the cam control and nut are engaged with a screw thread having a slow pitch. For example, a fast pitch of 32 threads per inch, as related to a slow pitch of 8 threads per inch. Thereby, the drive rod moves four times the distance of the cam control. This feature enables the entire installation of the cam control and related limit switches upon the servo actuator as a unit, as clearly shown in FIG. 7 of the drawings.

The remote hand held pilot station is characterized by the three vessel controlling functions, namely steering, throttling and shifting. Additional functions are starting S, stopping (kill) K, ignition IG, and the R.P.M. indicator, as shown in FIG. 2. All of these functions are correlated in the hand held pilot station shown in FIG. 2 and electrical diagram of FIG. 9. The controlling servos of the steering and throttle and shifting operatate individually, the throttle and shifting functions being electrically interrelated. The circuitry and cam control relationship of the shifting servo is unique, as there are three switches that determine the three distinct modes of operation.

SUMMARY OF THE INVENTION

A primary object of this invention is to provide a hand held pilot station for outboard powered vessels. This pilot station is mobile and is connected to the outboard powerhead through a multi channel relay means. Operation is electrical and relies upon the battery power supply of the outboard unit, for starting and for the three distinct servo functions of steering, throttling and shifting. Electrical connections are through flexible cables, the hand held pilot station being transportable to any desired location on the vessel. Each of the servos is characterized by a small high speed motor and gear drive, that inherently lock in selected positions, and which are quickly responsive for rapid operation of the functions involved. The three functions of steering, throttling and shifting are independently operable, the throttle and shifting functions being interrelated so as to prevent shifting at high engine speeds. The steering function is characterized by a gear segment that is captured to operate through a pinion drive means powered remotely through a flexible cable by a gear-head motor. The throttle function and shift functions are each characterized by a servo actuator having a nut and drive rod combination that reciprocably positions each lever system involved. The servo actuators employ reversible gear-head motors and with fast pitch nuts to reciprocate the drive rods. And, the shift function servo actuator includes a slow pitch thread on the nut in order to reduce the travel of the cam control that is installed integrally with the actuator as a unit.

The foregoing and various other objects and features of this invention will be apparent and fully understood from the following detailed description of the typical preferred forms and applications thereof, throughout which description reference is made to the accompanying drawings.

THE DRAWINGS

Figures 7, 8, 9:
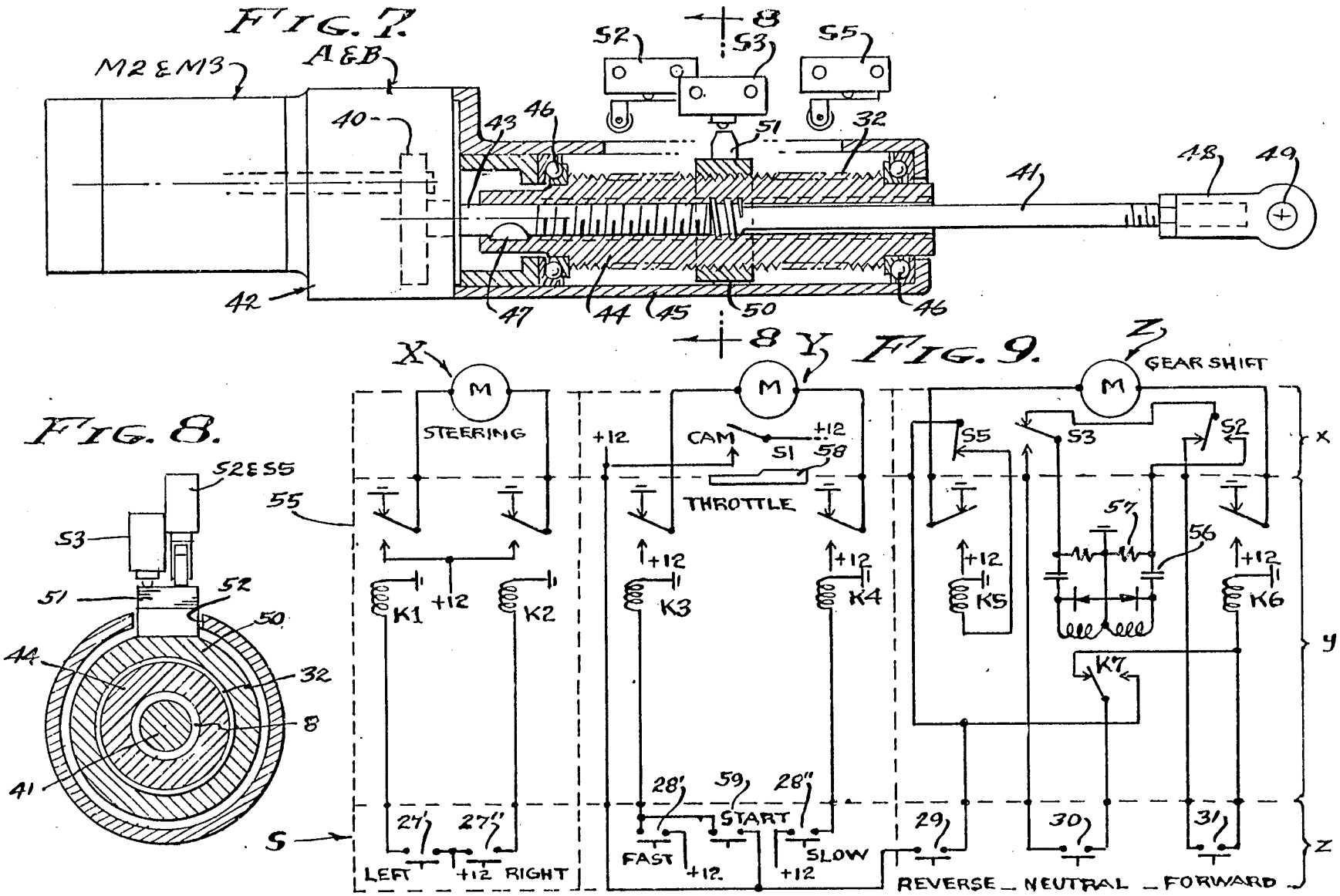
FIG. 7 is a longitudinal detailed section of the shift servo actuator.
FIG. 8 is an enlarged section taken as indicated by line 8—8 on FIG. 7.

And FIG. 9 is an electrical diagram of the circuitry.

PREFERRED EMBODIMENT

Figure 1:
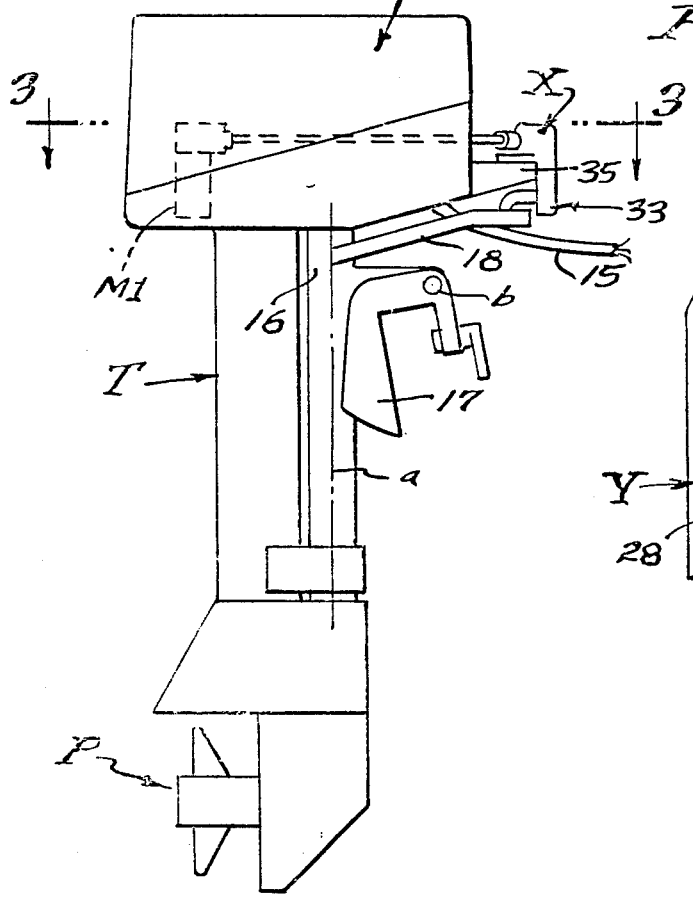
FIG. 1 is a side elevation of a typical outboard motor, showing the steering function servo installed thereon.
Figure 2:
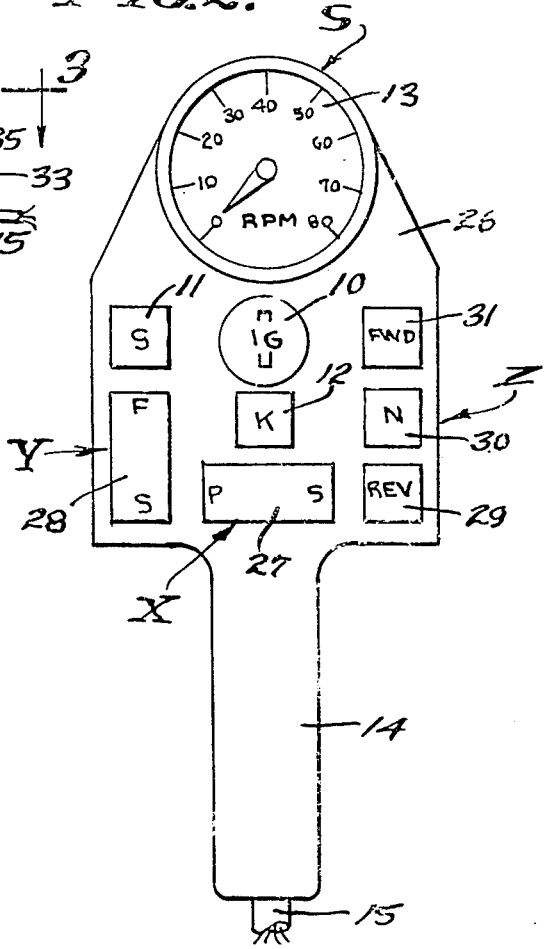
FIG. 2 is a front view of the hand held pilot station, showing functions for the complete operation of the vessel involved.

Referring now to the drawings, FIG. 1 illustrates an outboard motor having a powerhead H, a drive tube T and a propeller assembly P. In accordance with this invention there are three basic control functions; steering by left and right control means X, throttling by fast and slow control means Y, and shifting by reverse, neutral and forward control means Z. Each of said control means is characterized by an electric motor drive (see FIG. 9) and all of which are controlled by a hand held pilot station S as illustrated in FIG. 2. Additionally, the pilot station S includes ignition control means 10, start control means 11, kill or stop control means 12, and a tachometer 13. As shown, the pilot station S is carried by a hand held grip 14 from which a flexible cable 15 extends to the powerhead H. The powerhead H and drive tube T with the propeller assembly P pivot together on a substantially vertical axis a by means of a bracket 16 that swings on a transverse horizontal axis b secured to the transom of the vessel (not shown) by a mounting clamp frame 17, all in a conventional manner.

Figure 6:
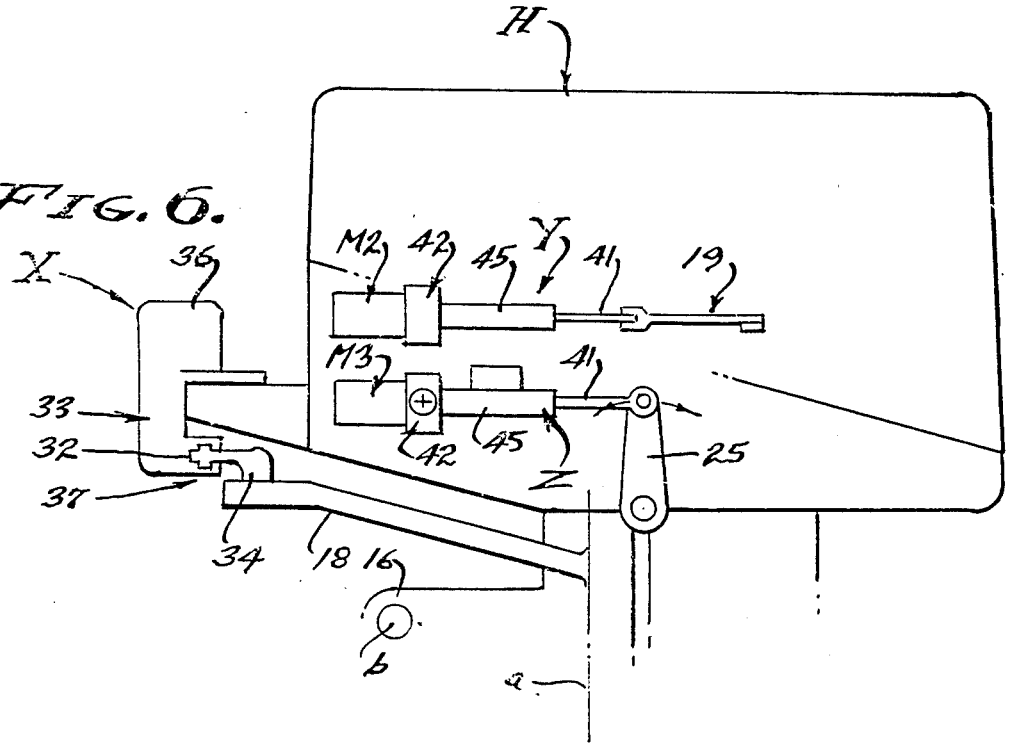
FIG. 6 is a side elevation taken as indicated by line 6—6 on Fig. 3 (rotated).

The powerhead H is characterized by three primary control functions, steering, throttling and shifting. Steering is by means of the powerhead-drive tube-propeller assembly pivoted on axis a, there being a steering bracket 18 as part of the bracket 16 closely overlying the mounting or clamp frame 17, to which steering cables are normally attached and to which the steering means X herein described is connected. Throttling is by means of a carburetor and magneto linkage 19 that simultaneously positions the carburetor 20 throttle shaft 20' through a link 21, and the magneto 22 plate 22' through a link 23, there being a lever 24 that is normally manually controlled and to which the throttling means Y herein described is connected. Shifting is by means of a gear shifting lever 25, the gears being located in the propeller assembly P and positioned by a rod extending to the powerehead H (not shown). Shifting lever 25 is located at one side of the powerhead as shown in FIG. 6 and to which the shifting means Z herein described is connected.

The hand held pilot station S includes a housing 26 carried by the grip 14 to expose the control elements for manipulation. There is a left to right (port to starboard) P and S rocker 27, shown in FIG. 9 as button switches 27' and 27''. There is a fast to slow F and S rocker switch 28, shown in FIG. 9 as button switches 28' and 28''. And there are separate button switches 29, 30 and 31 for reverse, neutral and forward gear shifting.

Figure 3:
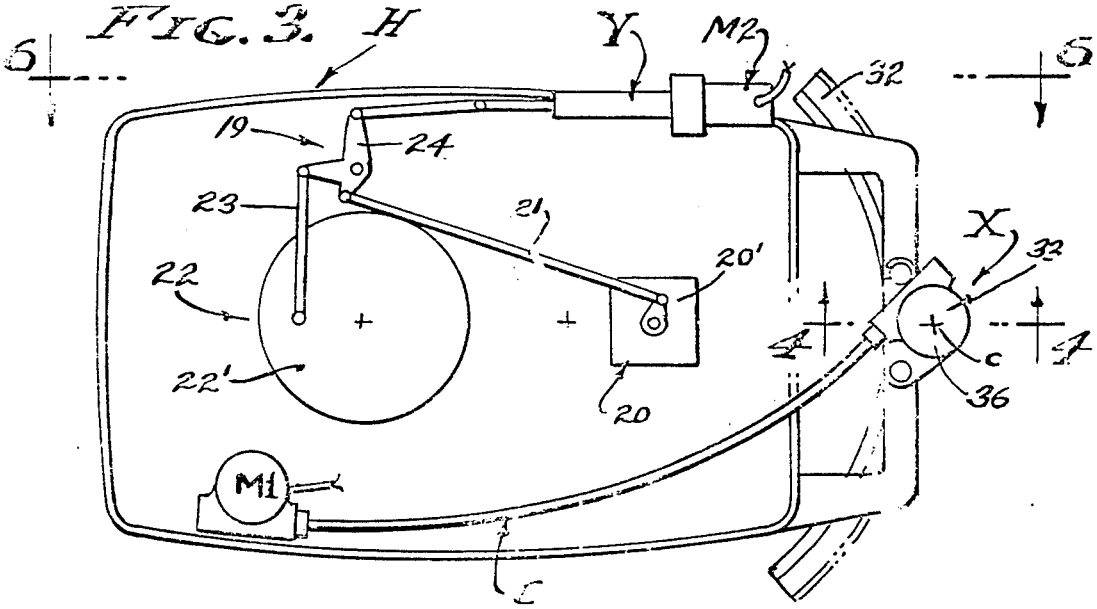
FIG. 3 is an enlarged plan view taken as indicated by line 3—3 on FIG. 1, showing the throttle function servo in addition to the steering servo.
Figure 4:
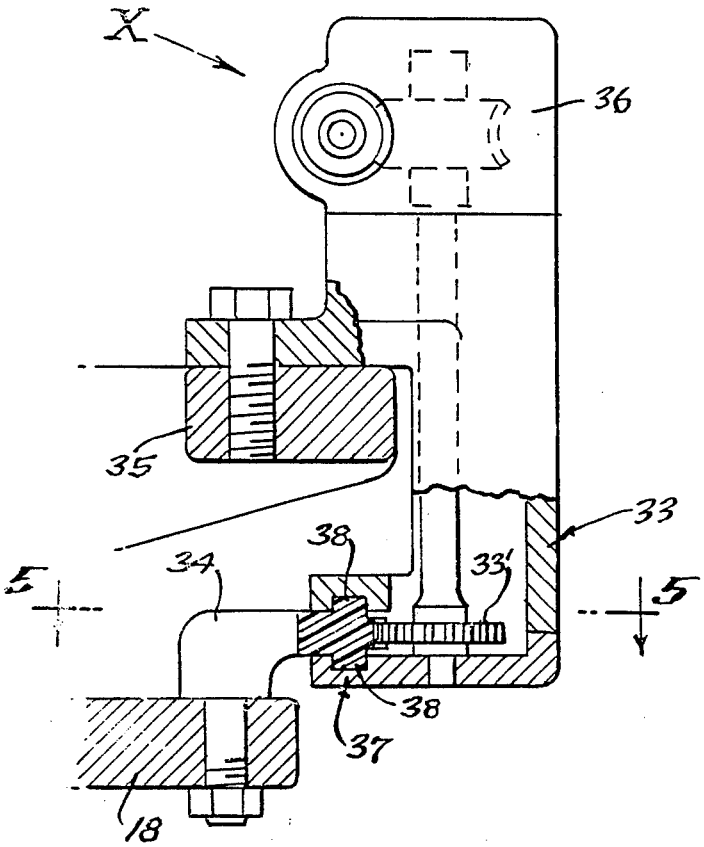
FIG. 4 is an enlarged view, partially in section, taken as indicated by line 4—4 on FIG. 3.
Figure 5:
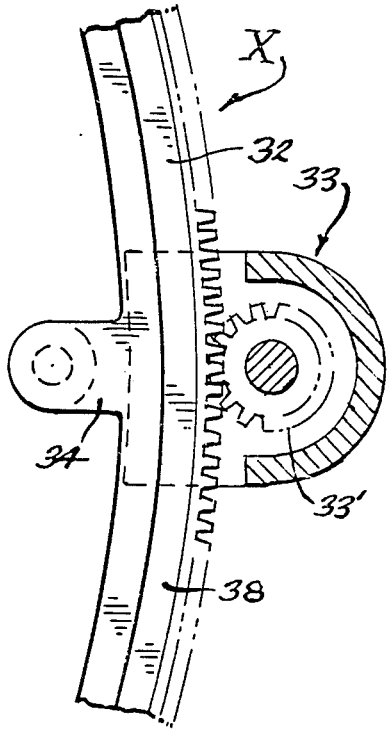
FIG. 5 is an enlarged detailed section taken as indicated by line 5—5 on FIG. 4.

Referring now to the steering control means X, the steering bracket 18 is positioned by a reversible motor M1 to positionably rotate the powerhead-drive tube-propeller assembly on the pivotal axis a . The means X is comprised of a segmental member 32 rotated about axis a by a drive means 33 reversely rotated by the motor M1. As shown, the segmental member 32 is an arcuate rack or the like, and the drive means 33 is a pinion gear 33' or the like. The rack member 32 is arcuate about the axis a and is secured to the steering bracket 18 by a gooseneck fitting 34, while the pinion gear 33' is carried by a bracket 35 of the powerhead H on an axis c parallel to the axis a (see FIG. 4). The motor drive to the pinion gear 33' can be direct on the axis c, or preferably remote through a gear box 36 and flexible cable c as best shown in FIG. 3. In practice, both the gear box 36 and motor M1 are speed reduction units, the motor M1 being a gear head motor. As a result, the gear reduction to the segment steering member 32 is substantial, for discrete positioning thereof. The gear box 36 is centrally mounted on the bracket 35 to have a depending shaft with the pinion gear 33' exposed rearwardly to engage the forwardly faced arcuate periphery of the segment steering member 32.

In accordance with this invention, the segment steering member 32 is flexible to the extent that it can be directed into uniform engagement with the pinion gear 33' by guide means 37 carried by the gear box 36. In practice, the segment steering member 32 is made of plastic material such Teflon or Nylon (trademarks) which are tough materials with substantial physical properties, so that the member 32 can be trained through the guide means 37 regardless of deflections between brackets 18 and 35. As shown, the guide means 37 slidably embraces arcuate top and bottom rails 38 on the member 32, so as maintain proper meshed engagement with the pinion gear 33'. The rails 38 are curved concentric with the axis a . The gear box 36 is shown to include a worm and gear drive that is self locking, so as to hold whatever steering position is set thereby. The remote gear head motor M1 is a small fractional horse power motor that s reversable and quick to accelerate, being located within the housing of the powerhead at one side thereof.

Referring now to the throttling control means Y, the carburetor and magneto linkage 19 is positioned by a reversible motor M2 to positionably rotate the carburetor 20 throttle shaft 20' and to simultaneously rotate the magneto plate 22'. The means Y is comprised of the aforesaid linkage 19 and its links 21 and 23 as shown in FIG. 3, all of which is actuated by servo means A next described, the linkage 19 being within the powerhead H housing, while the servo means A is either within or at the immediate exterior of the powerhead H housing, as shown.

Referring now to the shifting control means Z, the gear shifting lever 25 is positioned by a reversable motor M3 to seek three rotated positions as determined by switches S5, S3 and S2 (see FIGS. 7 and 9). The shifting lever 25 is located at the lower part of the powerhead H housing and is accessible at one side thereof, and which is actuated by servo means B next described. In practice, the servo means B is either within or at the immediate exterior of the powerehead H, as shown.

The servo means A and B are essentially the same as shown throughout the drawings. However, servo means B includes the switches S5, S3 and S2 in combination with a cam positioned by a thread pitch on a drive nut operating differentially with respect to a thread pitch thereof that positions the shifting lever 25. The servo means A, on the other hand, has a simple thread for selected positioning of the linkage 19.

The basic servo means A and B involves the motor M2 or M3, said motors being small fractional horse power motors that are reversible and quick to accelerate and decelerate. These motors are gearhead motors as shown with reduction gearing 40. The servo reciprocates a drive rod 41 that is prevented from rotating by its connection to the linkage 19 or lever 25, the active part of the rod 41 being coextensively threaded with a fast moving thread pitch, for example an 8 pitch thread. The gear head 42 has a projecting drive shaft 43 that is coupled to an elongated cylindrical nut 44 that is internally threaded to receive the threaded rod 41, the nut 44 being of a length to accomodate the stroke as required of the rod. A drive housing 45 is attached to and projects from the gear head 42 to enclose the nut 44, with a bearing or bearings 46 to carry the nut concentrically over the rod 41. The nut 44 is exposed at the terminal end of the housing 45 where the rod 41 reciprocally emanates. As shown, there are spaced bearings 46 at opposite ends of the cylindrical nut 44 to receive the opposite axial thrust thereof, said bearings being carried in the housing 45. As shown, the drive shaft 43 is coupled to the nut 44 by a key 47. Accordingly, reversible rotation of the nut 44 reciprocably positions the rod 41 as may be required. And, the terminal end of the rod 41 is coupled to the linkage 19 or lever 25 by an adjustable fitting 48 and pin 49, the inner end of the rod having but a few threads, 2½ 8 pitch threads for example, (see FIG. 7).

Referring now to the shifting control servo means B and to FIG. 7 of the drawings, the cylindrical nut 44 is provided with an external slow moving thread pitch, for example a 32 pitch thread, and an external follower nut 50 threadedly engages over said slow pitch thread. In this example the differential in movement between the internal fast moving 8 pitch thread and the external slow moving 32 pitch thread is four to one. Consequently, the follower nut 50 moves one fourth the distance of the drive nut 44 that reciprocates the rod 41, whereby a cam 51 carried by nut 50 reciprocates correspondingly well within the length of the servo unit housing 45. In accordance with this invention three switches S5, S3 and S2 are carried by the housing 45 as shown in FIG. 7 and positioned to respond to the cam 51 at diminished points of travel substantially less than the full travel of rod 41. In this way the servo means B and its controlling switches S5, S3 and S2 and associated drive motor M3 and housing 45 become a compact self contained unit that controls the three positions of the shifting lever 25. As shown, the switches are mounted at one side of housing 45, the cam 51 operating through a slot 52 in that side of the housing.

Referring now to the gear shifting control switches S5, S3 and S2, switch S5 limits travel of rod 41 when shifted to the reverse mode, Switch S2 limits travel of rod 41 when shifted to the forward mode, and switch S3 stops travel of rod 41 when shifted to the neutral mode. In practice, the switches S5 and S2 are adjustably positioned on the housing 45 at the limits of travel of the follower nut 50, and the switch S3 is adjustably positioned at the intermediate neutral position of said nut. The follower nut 50 represents the equivalent position of rod 41.

Referring now to the electrical control circuit of FIG. 9 of the drawings, the electrical system is located in three areas, on the powerhead H, in a relay box 55, and in the hand held pilot station S. There are relays K1 through K7 shown in their de-energized conditions, single pole double throw relays used to control motors M1, M2 and M3. Relay K7 is a two coil latching relay, used as a memory means, so that when the neutral button switch 30 is pressed the servo motor M3 will operate toward the neutral position regardless of its existing position. Capacitors 56 are used in the K7 circuit so that the coils thereof will not be continuously energized. And, resistors 57 are used in said K7 circuitry to discharge the capacitors so that gear shifting can be rapid. The control switches S5, S3, S2 and S1 are single pole double throw snap switches. And all control switches at the hand held pilot station S are normally open rocker or button switches.

Operation is as follows: Steering is by reversible operation of servo motor M1 by relays K1 and K2, as controlled by rocker switch 27 comprised of push button switches 27' and 27''. This operation is clear in the diagram of FIG. 9.

Throttling is by reversible operation of servo motor M2 by relays K3 nd K4, as controlled by rocker switch 28 comprised of push button switches 28' and 28''. The rod 41 of servo actuator A shifts a cam 58 that follows the throttle position, said cam having a rise that actuates switch S1 at moderate and all fast engine speeds and sets the throttle position at fast idle for engine starting and warm-up. Shift disablement is by switch S1 that disconnects power to the shifting circuit, shown as +12 volts. Fast idle is set by first placing the throttle to the extreme slow position, by pressing the slow button switch 28'', followed by pressing and holding the start button switch 59, whereby the throttle position will increase until switch S1 disables the start button switch 59.

Gear shifting is by the reversible operation of servo motor M3 by relays K5, K6 and K7, as controlled by push button switches S5, S3 and S2. The servo motor M3 positions the cam 51 which has three mode positions; forward, neutral and reverse modes. Each position actuates one of said switches, switch S3 being actuated only when the cam 51 is in the neutral position. Switch S2 is actuated only when cam 51 is in the forward position. And switch S5 is actuated only when cam 51 is in the reverse position. When switch S5 is actuated, both switches S2 and S3 are unactuated, and both sets of their normally closed contacts closed. When the switch S5 is actuated, its normally closed contacts are opened. Since the servo motor M3 must operate in an opposite direction so as to go to neutral from forward than it does in order to go to neutral from reverse, relay K7 determines proper direction of its operation when the neutral button switch 30 is pressed.

Assuming that the throttle position is such that the switch S1 contacts are closed, +12 volts is applied. Beginning from a neutral position of cam 51; pressing the forward button switch 31 energizes relay K6 putting +12 volts on the forward circuit of motor M3 and shifting the cam 51 to the forward position. As soon as the cam 51 leaves the neutral position switch S3 is deactivated, and when the cam 51 reaches the forward position switch S2 is activated to close the normally open contacts and opening the normally closed contacts thereof. This disables the forward button switch 31 and momentarily energizes the setting coil of the relay K7. Since relay K7 is a latching relay it will remain in this condition until the resetting coil is energized. The servo means B is thereby moved into the forward mode.

In order to operate the servo means B from the forward mode to the neutral mode, the neutral button switch 30 is pressed so that current flows through switch S2, through switch 30 and through the contacts of relay K7 to energized relay K5, which causes the servo motor M3 to operate in a reverse direction until it reaches the neutral position. Switch S3 is then activated to disable the switch 30 and reset the relay K7. The servo means B is thereby moved into the neutral mode.

In order to operate the servo means B from the neutral mode into the reverse mode, the reverse button switch 29 is pressed putting +12 volts on the reverse circuit of motor M3, shifting the cam 51 to the reverse position. When the cam 51 reaches the reverse position, switch S5 is actuated, disabling the reverse button switch 29.

In order to operate the servo means B from the reverse mode to the neutral mode, the neutral button switch 30 is pressed. Since relay K7 is reset, relay K6 is now energized, operating the cam 51 toward the forward position. Again, the cam 51 reaches the neutral position and switch S3 deactivates the neutral button switch 30 and applies a resetting voltage to relay K7 (relay K7 was previously reset).

Having described only the typical preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A control for outboard powerheads pivoted on a steering axis and having a throttle means and a shifting means lever for operation between reverse and forward positions through a neutral position, and including;

a reversible motor and pinion engaged with a segmental member and acting between the powerhead and a mounted bracket therefor to turn the powerhead reversely on the steering axis, a reversible motor and servo means engaged with the throttle means and having a reciprocably shiftable rod engaged with and positioning the throttle means, and having a cam with a rise engageable with and to open a cam engageable switch at moderate and all fast powerhead speeds and said cam engageable switch being in circuit with a start switch to disable the same, a reversible motor and servo means engaged with the shifting means lever and having a reciprocably shiftable rod shiftable between said reverse and forward positions through said neutral position, and a circuit means having right and left switches to reversibly operate the reversible motor and pinion engaged with said segmental member to steer, having fast and slow switches to reverseibly operate the reversible motor and servo means engaged with said throttle means, and having reverse, forward and neutral switches with means to reversely operate the reversible motor and servo means and shiftable rod engaged with the shifting means lever to shift it between neutral and reverse and between neutral and forward positions.

2. The control for outboard powerheads as set forth in claim 1, wherein the circuit means switches are accessibly carried by a hand held pilot station remotely connected by a cable to the powerhead.

3. The control for outboard powerheads as set forth in claim 1, wherein the circuit means switches are accessibly carried by a hand held pilot station remotely connected by a cable through a relay means and to the powerhead, there being right and left relays in circuit with said right and left switches, there being slow and fast relays in circuit with said slow and fast switches, and there being reverse, forward and neutral relays in circuit with said reverse, forward and neutral switches.

4. The control for outboard powerheads as set forth in claim 1, wherein said cam engageable switch of the reversible motor and servo means is also in circuit with the aforesaid reverse switch to disable the same.

5. A control for outboard powerheads pivoted on a steering axis and having a throttle means and a shifting means lever for operation between reverse and forward positions through a neutral position, and including;

a reversible motor and pinion engaged with a segmental member and acting between the powerhead and a mounted bracket therefor to turn the powerhead reversely on the steering axis, a reversible motor and servo means engaged with the throttle means and having a reciprocably shiftable rod engaged with and positioning the throttle means, a reversible motor and servo means engaged with the shifting means lever and having a reciprocably shiftable rod shiftable between said reverse and forward positions through said neutral position, and having a cam engageable with and to open a cam engageable switch in each of said reverse, forward and neutral positions and said switches being in circuit with the aforesaid reverse, forward and neutral switches to disable the same, and a circuit means having right and left switches to reversibly operate the reversible motor and pinion engaged with said segmental member to steer, having fast and slow switches to reversibly operate the reversible motor and servo means engaged with said throttle means, and having reverse, forward and neutral switches with means to reversely operate the reversible motor and servo means and shiftable rod engaged with the shifting means lever to shift it between neutral and reverse and between neutral and forward positions.

6. The control for outboard powerheads as set forth in claim 5, wherein the reversible motor and servo means engaged with and shifting the shifting means lever includes a latching relay means in circuit with the switch opened by said cam in neutral position to alternately enable motor operation between said reverse and neutral and between said forward and neutral positions.

7. The control for outboard powerheads as set forth in claim 5, wherein the circuit means, switches are accessibly carried by a hand held pilot station remotely connected by a cable to the powerhead.

8. The control for outboard powerheads as set forth in claim 5, wherein the circuit means switches are accessibly carried by a hand held pilot station remotely connected by a cable through a relay means and to the powerhead, there being right and left relays in circuit with said right and left switches, there being slow and fast relays in circuit with said slow and fast switches, and there being reverse, forward and neutral relays in circuit with said reverse, forward and neutral switches.

* * * * *